United States Patent [19]

Durtschi et al.

[11] Patent Number: 4,688,469

[45] Date of Patent: Aug. 25, 1987

[54] FAULT DETECTOR FOR A TRIPLEXED MECHANICAL OR HYDROMECHANICAL SYSTEM

[75] Inventors: William G. Durtschi, Rockford; Linda M. Dschida, Stillman Valley; David J. Lang, Rockford, all of Ill.

[73] Assignee: Sundstrand Corporation, Rockford, Ill.

[21] Appl. No.: 789,456

[22] Filed: Oct. 21, 1985

[51] Int. Cl.[4] ..... F15B 13/16; F15B 11/00

[52] U.S. Cl. ..... 91/388; 91/390; 91/509; 244/226

[58] Field of Search ..... 91/509, 510, 385, 386, 91/388, 390; 137/596.16; 244/78, 226

[56] References Cited

U.S. PATENT DOCUMENTS

| | | | |
|---|---|---|---|
| 2,856,788 | 10/1958 | Jovanovich | 74/469 |
| 3,051,137 | 8/1962 | Kutzler | 121/38 |
| 3,269,676 | 8/1966 | Hopkins | 244/78 |
| 3,411,410 | 11/1968 | Westbury et al. | 91/1 |
| 3,438,306 | 4/1969 | Kazmarek | 91/171 |
| 3,464,319 | 9/1969 | Sherman et al. | 91/411 |
| 3,527,143 | 9/1970 | Hayter | 91/411 |
| 3,762,237 | 10/1973 | Stevko | 74/479 |
| 4,403,756 | 9/1983 | Berlin et al. | 244/226 X |

*Primary Examiner*—Robert E. Garrett
*Assistant Examiner*—Mark A. Williamson
*Attorney, Agent, or Firm*—Wood, Dalton, Phillips, Mason & Rowe

[57] ABSTRACT

A fault detector for a triplexed mechanical or hydromechanical system which provides for improvement in cost, reliability and weight over previously known balance beam arrangements for achieving redundant two-channel operation to provide a fail-operating first failure mode for operation of aircraft components which require reliable operation for flight safety. The fault detector for a triplexed mechanical or hydromechanical system has a tripodal summing member which receives three mechanical position signals in three different channels with the tripodal summing member retaining a position perpendicular to the force transmitted by the tripodal summing member in response to the position signals and tipping when one of the input signals deviates significantly from the other two. A structure for detecting a malfunction senses a greater amount of movement of the tripodal summing member at its connection to the mechanical position signal which is malfunctioning to provide an indication as to which mechanical position signal is faulty. In response to detection of the faulty operation, a mechanism disconnects the channel having the faulty operation. An alignment structure is operable to restore the tripodal summing member to its normal perpendicular position to enable continued operation by means of the mechanical position signals which are still accurate.

20 Claims, 5 Drawing Figures

FAULT DETECTOR FOR A TRIPLEXED MECHANICAL OR HYDROMECHANICAL SYSTEM

TECHNICAL FIELD

This invention pertains to a fault detector for a triplexed mechanical or hydromechanical system which provides redundant two-channel operation in order to achieve continuing operation after a failure in one channel. There are many requirements for such a system, particularly in the operation of aircraft components in order to assure continued operation even after failure of one channel.

BACKGROUND ART

A typical way of accomplishing continued operation of an aircraft component, after failure of one operating mechanism is by the use of a quadruplexed system in which two sets of two signals are used. Each output signal representing a desired output position constitutes a channel of operation and the output signals of the two channels of one set of signals are mechanically compared by a balance beam arrangement. If the balance beam tips representing a disagreement between the two output position signals, a failure is indicated. There is no way to discriminate which of the two channels is not operating properly and, therefore, both channels must be considered to be in error and must be shut down or bypassed. Redundant operation can still occur, since this leaves the other set of two output signals operating as two channels still operating. The disadvantage of this quadruplexed system is that it is always necessary to shut down two channels of operation anytime a fault is indicated, which shuts down one-half of the system. Another consequence of this approach is that four sets of hardware are required, with resulting impact on cost as well as reliability and weight which are important factors in aircraft use.

The foregoing prior art does not disclose a system wherein three mechanical output signals of three separate channels can be compared to enable an improperly operating channel to be identified and shut down or bypassed. This leaves two operative channels with resulting improvement in system reliability, cost and weight over a quadruplexed system.

The Westbury et al. U.S. Pat. No. 3,411,410 discloses position control servo systems using a tripodal force-transmitting member rigidly connected to three actuating pistons for the member. Faulty operation of one of the actuating pistons is detected by sensing elements associated, one with each of the actuating pistons which are connected to three legs of a three-armed lever 14 constituting an averaging member and which is pivotally mounted at a central ball carried by a fixed reactor member. Faulty operation of one of the actuating pistons results in tipping movement of the three-armed lever 14, to result in differential movement of members associated therewith to indicate the actuating piston which is not operating properly. The three-armed lever is not connected into the system to be a force-transmitting member for transmitting the output position signals from the actuating pistons to an element to be positioned by the output signals.

The Stevko U.S. Pat. No. 3,762,237 discloses a digitally-controlled linear actuator having a tripodal summing device in the form of a spider assembly having three legs, each of which can receive an output position signal and transmit these signals to an output member pivotally connected to the spider assembly at a location interiorly of the three locations at which the output signals are applied and which define the apices of a triangle.

The prior art does not disclose a fault detector for a triplexed mechanical or hydromechanical system wherein: three output position signals in three separate channels are applied to a tripodal summing member pivotally connected to a force-transmitting member for positioning an operating device; the failure in one output position signal is evidenced by tipping of the tripodal summing member to give an indication as to which output position signal is incorrect; and through the use of appropriate detecting structure, the channel providing the deviant output position signal can either be shut down or bypassed and continued redundant operation is carried out by the remaining two channels each having an output position signal which is accurately delivered to the tripodal summing member.

DISCLOSURE OF THE INVENTION

A primary feature of the invention is to provide a fault detector for a triplexed mechanical or hydromechanical system wherein three separate output position signals in three separate channels are applied to a pivoted tripodal summing member, with the tripodal summing member transmitting the signals to a device to be operated and with a failed or inaccurate output position signal resulting in tipping of the tripodal summing member which is sensed by detecting means to initiate appropriate action, such as disconnecting or bypassing the channel which is delivering the inaccurate output position signal. Means are also provided to permit continued operation using the two output position signals from the remaining two channels after bypass or disconnection of the faulty channel.

In accomplishing the foregoing, the triplexed mechanical or hydromechanical system provides for force-summing three output position signals applied to a tripodal summing member at three locations defining the apices of a triangle and the tripodal summing member is pivotally connected to a force-transmitting member at a location within the interior of the triangle defined by the three apices. When the output position signals are all equal, the force-summing member is moved without pivoting to cause movement of the force-transmitting member and the tripodal summing member remains in a perpendicular relation to the force-transmitting member. If there is a failure or inaccuracy in one of the output position signals, the tripodal summing member will pivot from its position perpendicular to the force-transmitting member and the connection thereof to the faulty channel having the faulty output position signal will be displaced twice as far as the connections to the two remaining channels which each have one of the correct output position signals. The greater displacement is sensed to operate a device, such as a valve, which may disconnect or bypass the faulty channel. Additionally, means are provided for restoring the tripodal summing member to its position perpendicular to the force-transmitting member and locking the tripodal summing member in such position to enable continued redundant operation by the remaining two channels having the two accurate output position signals.

An object of the invention is to provide a new and improved triplexed mechanical or hydromechanical system having a fault detector associated therewith wherein redundant operation is provided by force-summing three output position signals in each of three channels by a summing member which transmits the output position signals to a device to be operated and with the three output position signals being spaced about a ball or swivel-type joint for the summing member, whereby the lack of, or inaccuracy of one of, the three output position signals can be sensed by resultant tipping of the summing member and appropriate action taken to remove the inoperative or inaccurate channel from operation.

Still another object of the invention is to provide a system as defined in the preceding paragraph wherein the summing member can be restored to operative position after movement which detects a faulty channel and held in operative position whereby there can be continued operation of the system from the remaining output position signals applied to the summing member in the remaining two channels.

Another object of the invention is to provide a fault detector for a triplexed actuation system having three mechanical inputs comprising, a movable summing member having a pivotal connection to said three inputs at spaced-apart locations, a force-transmitting member pivotally connected to said summing member for transmitting an output responsive to movement of the summing member, and means for detecting the position of the summing member when the three mechanical inputs are not applied equally to the summing member.

Still another object of the invention is to provide a fault detector for a triplexed actuation system having three separate input movements comprising, a movable summing member, means acting on said movable summing member at three spaced locations to apply said input movements individually one at each location to the summing member, a force-transmitting member extending from said summing member at a location within a perimeter defined by said locations and having a pivotal engagement with the summing member, and means for detecting when the summing member is moved by less than three of said input movements or when said input movements are not of equal magnitude.

An additional object of the invention is to provide a fault detector for a triplexed hydromechanical system having three mechanical position signals comprising, a pair of hydraulic valves having their valve members in spaced-apart alignment and connected together by a connecting member, a summing plate positioned between said hydraulic valves and having a swivel connection interiorly thereof to said connecting member, three members pivotally connected to said summing plate at spaced-apart locations defining apices of a triangle, three independent actuators connected one to each of said members to provide said three mechanical position signals to said summing plate, feedback means between said actuators and said hydraulic valves, and means associated with the feedback means for detecting when a hydraulic valve has not operated in accordance with the operation of the associated actuator for disabling the associated actuator.

BEST MODES FOR CARRYING OUT THE INVENTION

Figure 1:
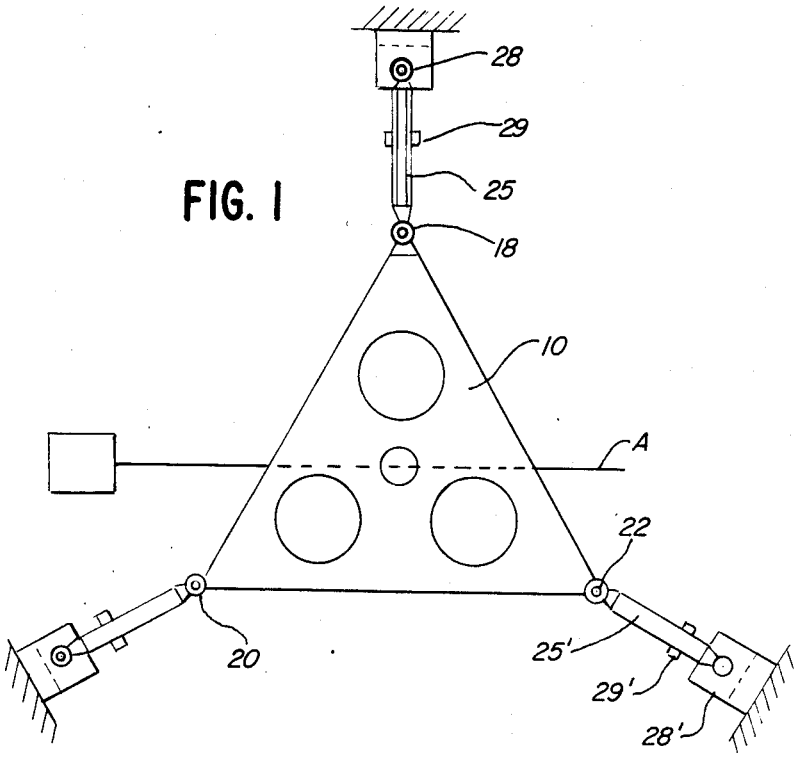
FIG. 1 is a schematic elevational view of one embodiment of the fault detector for a triplexed mechanical system.
Figure 2:
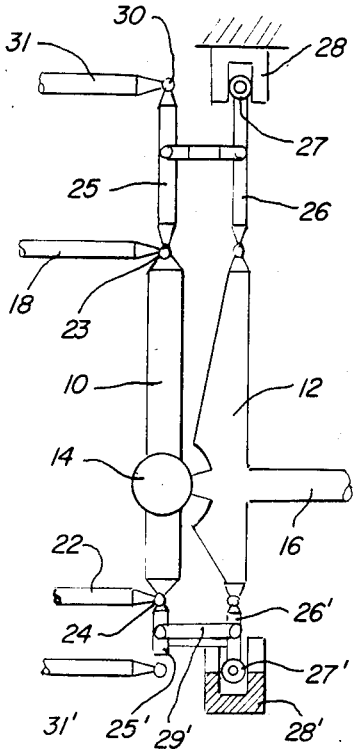
FIG. 2 is a side elevational schematic of the mechanism shown in FIG. 1.
Figure 3:
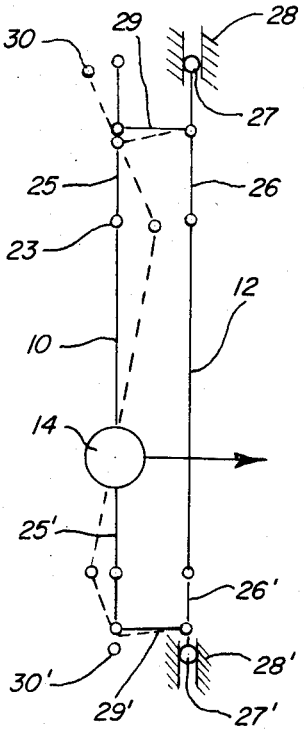
FIG. 3 is a graphic illustration of a fault-detecting movement of the mechanism shown in FIGS. 1 and 2.

A first embodiment of the invention is shown in FIGS. 1 to 3 which disclose schematically a triplexed mechanical system having a fault detector. A movable summing member 10, in the form of a tripodal summing plate, is pivotally associated with a force-transmitting member 12 through a force-transmitting connection provided by a ball joint 14 and with the output motion being transmitted through an output member 16 integral with the force-transmitting member 12.

The tripodal summing plate 10 receives three mechanical signals from three separate channels through input links 18, 20 and 22 which are pivotally connected to the tripodal summing plate by ball joints 23 and 24 as shown for the input links 18 and 22 in FIG. 2. The input links connect to the tripodal summing plate at three locations which define the apices of a triangle and with the ball joint 14 disposed interiorly thereof. Forces delivered to the tripodal summing plate 10 from the three input links are summed by the tripodal summing plate 10 and transmitted through the ball joint 14 to the force-transmitting member 12 and the output member 16. During normal operation, the mechanical input signals are equal and, as a result, the tripodal summing plate 10 remains parallel to the force-transmitting member 12 and perpendicular to the direction of the transmitted force.

When one of the mechanical input signals deviates from the other two, the tripodal summing plate 10 is caused to tip or pivot about the ball joint 14 from the previously-mentioned perpendicular position. This movement results in generation of a fault signal by linkage associated with the tripodal summing plate 10 and the force-transmitting member 12. There are three sets of fault-detecting linkage associated one with each input link.

The fault-detecting linkage associated with the input link 18 includes a pair of normally parallel links 25 and 26 pivotally connected at one of their ends to the tripodal summing plate 10 and the force-transmitting member 12, respectively. The link 26 is pivotally and movably mounted by means of a roller 27 movably mounted in a track 28 fixed to a frame. Interiorly of their ends, the links 25 and 26 are pivotally interconnected by a link 29. The other end of the link 25 is pivotally connected at 30 to a fault signal output link 31.

Each of the input links 20 and 22 has a similar fault-detecting linkage structure and with the structure associated with the input link 22 being seen in FIG. 2 and given the same reference numerals as the fault-detecting linkage associated with the input link 18, with a prime affixed thereto.

When one mechanical input signal deviates from the other two, the displacement of the fault signal output link 31 associated with the particular input link giving the faulty signal is twice that of the corresponding fault signal output links associated with the other two input links. This enables a detection of the difference in displacements and provides an indication as to which mechanical input signal is faulty and enables proper disconnection or bypassing of the channel having the faulty input signal. This action is illustrated in FIG. 3 which graphically illustrates a portion of the structure shown in FIG. 2 in normal position in full line and in a fault-sensing position in broken line. Assuming the mechanical input signal delivered by the input link 18 is faulty and deviates from the mechanical inputs of the input links 20 and 22, the tripodal summing plate 10 will tip about a datum A to a position which may typically be illustrated by the broken line showing in FIG. 3. The link 25 pivots through a greater arc than the link 25' and, thus, there is a greater shift of the pivot connection 30 and the fault signal output link 31 than there is of the pivot connection 30' and the fault signal output link 31' as well as the fault signal output link associated with the input link 20.

In the event the faulty input signal is delivered by one of the other input links 20 and 22, there is a different datum about which the tripodal summing plate 10 pivots. However, there is still the similar result, in that the fault signal output link associated with a particular input link providing the faulty signal will move twice as far as the other two fault signal output links.

Figure 5:
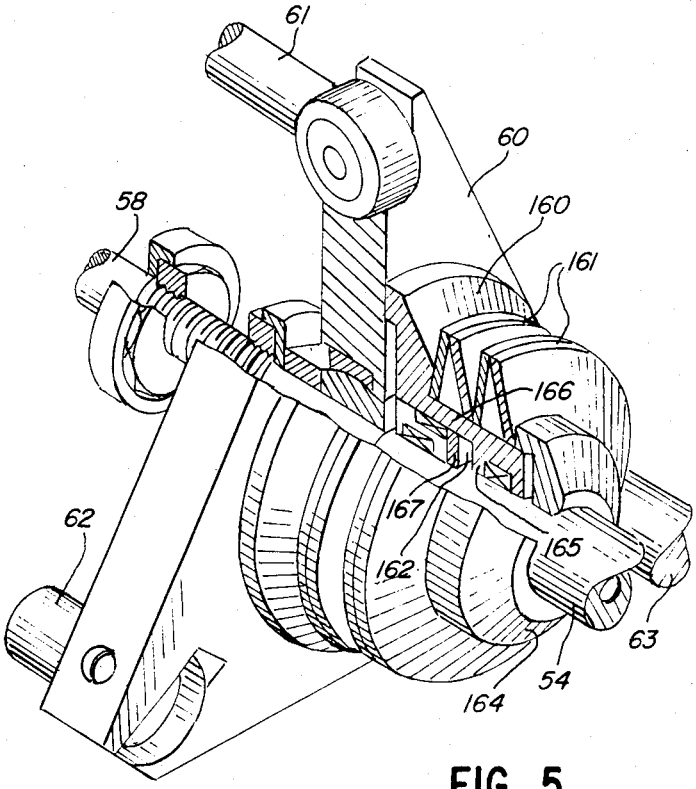
FIG. 5 is a perspective, fragmentary view on an enlarged scale showing the locking mechanism for the tripodal summing member.
Figure 4:
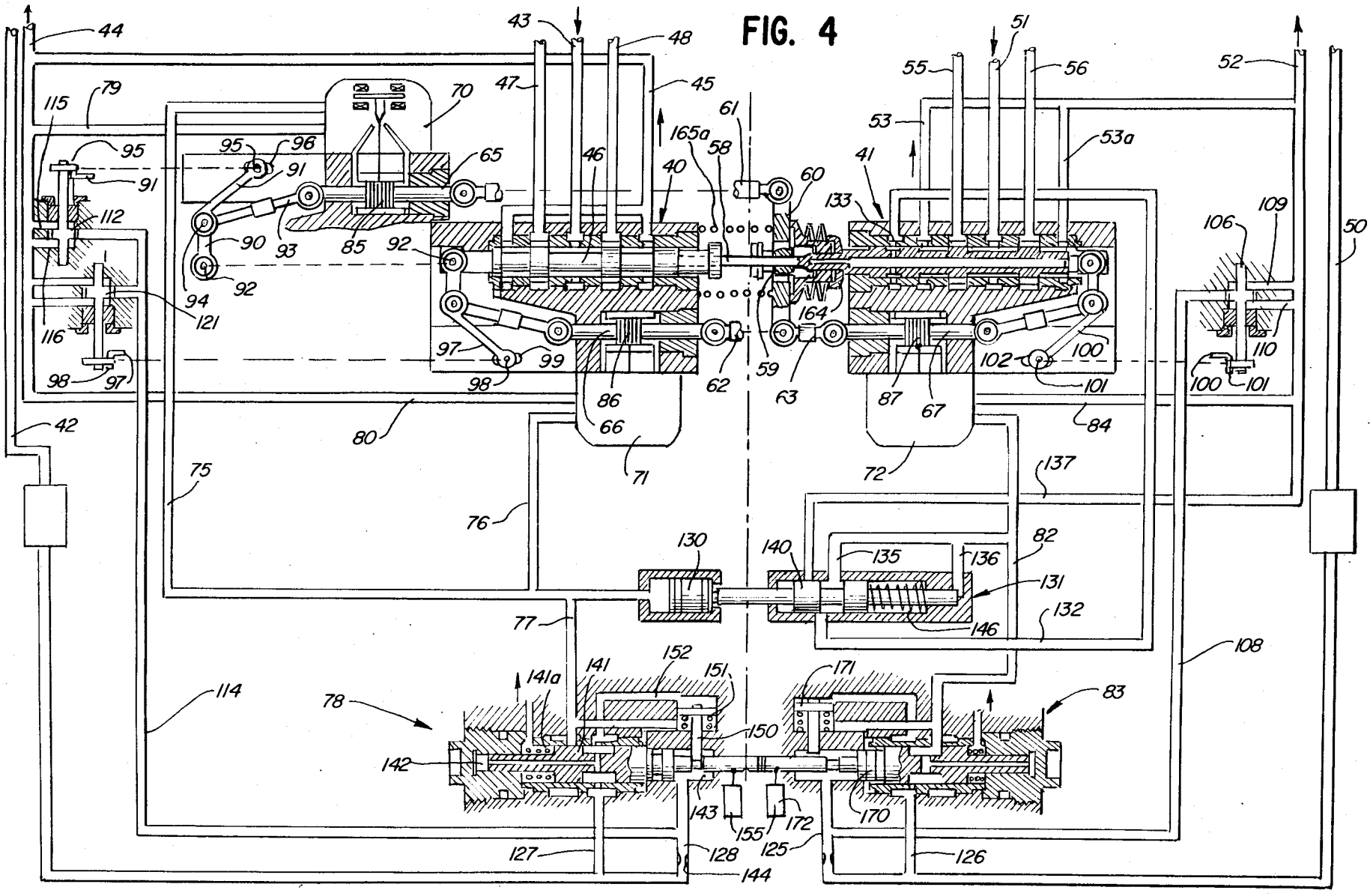
FIG. 4 is a hydraulic schematic of a triplexed hydromechanical system having the fault detector.

The principles embodied in the fault detector for a triplexed mechanical system can also be embodied in a triplexed hydromechanical system which is shown in the embodiment of FIGS. 4 and 5.

The hydromechanical system has a pair of main control valves, indicated generally at 40 and 41, forming parts of two separate hydraulic power systems having their own hydraulic supply and return lines and for controlling the connection of the supply and return lines with a pair of control fluid lines.

A first of the hydraulic power systems has a pair of supply lines 42 and 43 connected to a source of hydraulic fluid under pressure, with the supply line 43 connected to the main control valve 40. A return line 44 connects to a main control valve 40 through a line 45 and the main control valve 40 has a valve member 46 positionable to control communication of a pair of control lines 47 and 48 with supply and return.

There is similar structure in the second hydraulic power system, with supply lines 50 and 51 connected to a source of hydraulic fluid under pressure and the supply line 51 connected to the main control valve 41. A return line 52 connects to the main control valve 41 through lines 53 and **53*a* and a valve member 54 of the main control valve 41 is positionable to control the communication of the supply and return lines with a pair of control fluid lines 55 and 56**.

The valve members 46 and 54 of the main control valves 40 and 41 are in spaced-apart, aligned relation and connected by a force-transmitting member 58 in the form of a rod having a ball joint 59 pivotally mounting a tripodal summing plate 60. Three input links 61, 62 and 63 are pivotally connected at one of their ends to the tripodal summing plate 60 in a manner corresponding to the pivotal connection of the input links 18, 20 and 22 in the embodiment of FIGS. 1 to 3. These input links provide mechanical input signals to the tripodal summing plate as caused by their connection to spool actuators 65, 66, and 67 of three separate electro-hydraulic servo valves 70, 71 and 72, respectively.

Hydraulic power is provided to the electro-hydraulic servo valves 70 and 71 by the first hydraulic power system and to the electro-hydraulic servo valve 72 by the second hydraulic power system. More particularly, the electro-hydraulic servo valves 70 and 71 are connected to supply through respective lines 75 and 76 which communicate with a line 77 communicating with the supply line 42 through a shutoff valve, indicated generally at 78. The electro-hydraulic servo valves 70 and 71 are connected to return by means of return lines 79 and 80, respectively.

The electro-hydraulic servo valve 72 is connected with supply line 50 by means of a line 82 with the communication therebetween being controlled by a shutoff valve, indicated generally at 83. This electro-hydraulic servo valve connects to return by means of a return line 84.

During normal operation, electrical analog command signals are applied to each of the three electro-hydraulic servo valves 70–72 which are of a commercially-available jet pipe type and which operate in the known manner to direct hydraulic power to either side of a respective spool 85, 86 and 87 of the spool actuators 65–67. A pressure difference at opposite sides of the spools results in movement of the spool actuators with an internal feedback operating to maintain the new position of the spool actuator once the commanded position is reached.

In the arrangement seen in FIG. 4, the command signals applied to the electro-hydraulic servo valves would cause movement of the spool actuators 85 and 86 in the same direction, for example, to the right as viewed in FIG. 4 and cause movement of the spool actuator 67 also to the right. With proper analog command signals applied to the electro-hydraulic servo valves from a controller and with these valves operating properly, there will be uniform movement of all three spool actuators and, therefore, movement of the tripodal summing plate 60 toward the right, in the example given. In this operation, both of the valve members 46 and 54 of the main control valves 40 and 41 will be shifted equally toward the right, with the movement being that of the tripodal summing plate 60 which is the same as the movement of any one of the spool actuators. The summing plate is positioned perpendicular to the main control valves and to the path of travel of the connecting member 58 and remains so oriented.

There is a mechanical feedback linkage between each of the spool actuators and the valve member of the associated main control valve. This mechanical feedback linkage between the electro-hydraulic servo valve 70 and the valve member 46 includes a link having arms 90 and 91 with the arm 90 pivotally connected to the valve member 46 at a pivot connection 92 therebetween and with the parts shown separated by a broken line for illustrative purposes. A link 93 is pivotally connected to the spool actuator 65 at one end and at its other end is pivotally connected at 94 to the link having the arms 90 and 91. The arm 91 has a pin 95 movable within a slot 96 in a failure detection piston 112 to a position either side of that shown in FIG. 4 for a purpose to be described. Feedback linkage between the spool actuator 66 and the valve member 46 is of the same construction as just described and with an arm 97 having a pin 98 movable in a slot 99 in a failure detection piston 121.

The spool actuator 67 has a feedback linkage associated with the valve member 54 of the same construction as described, including an arm 100 having a pin 101 movable in a slot 102 in a failure detection piston 106.

In FIG. 4, the arms 91, 97 and 100 and associated pins are shown at two locations as indicated by broken lines to enable a clear showing of failure detection pistons 106, 112 and 121. When one of the spool actuators 65, 66, 67 does not move to the same extent that the other spool actuators move, there will be tipping of the tripodal summing plate 60 as described in connection with the embodiment of FIGS. 1 to 3 and, as a result, there will not be movement of the valve members 46 and 54 equalling the movement of the spool actuators. As described in connection with FIG. 3, the summing plate 60 will have greater movement at the location of the faulty input and this will result in a greater movement of one of the pins 95, 98, 101 to thus provide detection means for signalling a malfunction of an actuator.

Assuming the spool actuator 67 has failed to operate properly, the extent of movement of the pin 101 in the slot 102 will operate the failure detection piston 106 which will connect the supply line 50 to the return line 52 by opening a line 108 extending between the supply line 50 and the failure detection piston 106 to the return line through either of a pair of lines 109 or 110.

If the failure is associated with the spool actuator 65, the greater movement is of the pin 95 to operate the failure detection piston 112 to connect the supply line 42 to the return line 44 through a line 114 extended between the line 42 and the failure detection piston 112, with the latter controlling the connection to return line 44 through either passage 115 or 116.

The pin 98 connects to the failure detection piston 121 which similarly to the failure detection piston 112 functions to connect the return line 114 to the return line 44 when the pin 98 has moved a distance indicating malfunctioning of the spool actuator 66.

The shutoff valves 78 and 83 have both an open position and a lock position, with the open position thereof shown for shutoff valve 83 and the shutoff valve 78 being shown in the lock position. In the open position, as shown for shutoff valve 83, supply pressure from supply line 50 is in lines 125 and 126 extending to the shutoff valve and there can be flow from line 126 through the shutoff valve to line 82 to provide supply fluid to the electro-hydraulic servo valve 72. With respect to shutoff valve 78, there are supply lines 127 and 128 extending from supply line 42 to the shutoff valve and, when in the open position, supply pressure passes through the shutoff valve 78 to the line 77 which communicates with lines 75 and 76 to deliver supply pressure to the electro-hydraulic servo valves 70 and 71 and also to a control piston 130 of a tripodal alignment valve, indicated at 131. The tripodal alignment valve has an outlet line 132 extending to a port 133 of the main control valve 41 and also has a pair of line connections 135 and 136 to the line 82 extending from the shutoff valve 83 to electro-hydraulic servo valve 72 as well as a return line 137 connecting to the return line 52.

In normal operation, both of the shutoff valves 78 and 83 are in open position whereby all the electro-hydraulic servo valves are provided with supply pressure and the tripodal alignment valve 131 has its valve member 140 in the position shown because of supply pressure acting on the area of piston 130 which is larger than the end of the valve member 140 exposed to supply pressure through the line 136. As a result, supply pressure in line 82 is directed to the port 133 of the main control valve 41 through lines 132 and 135 to hold inoperative a certain mechanism which can be brought into operation to restore the tipped summer plate 60 to the perpendicular position shown in FIG. 4.

Assuming either of the failure detection pistons 112 or 121 are operated, supply pressure in the first hydraulic power system is ported to the return, line 44 and a valve member 141 of the shutoff valve 78 is caused to move to the lock position shown in FIG. 4. The valve member 141 moves as a result of the action of a spring 141*a* acting on the valve member 141 as well as a force resulting from fluid pressure in a chamber 142 acting on the end of the valve member and supplied from the supply line 127 through an internal passage in the valve member. The shift is a snap action because of the combination of pressure and spring force and the connection of line 114 to the return line 44 which immediately releases pressure from a chamber 143 which acts on the opposite end of the valve member. Pressure is substantially maintained in the supply line 127 because of the orifice 144. With supply pressure cut off to the line 77 extending from the shutoff valve 78, there is a gradual bleeding of pressure acting on the control piston 130 of the tripodal alignment valve 131 by bleeding through electro-hydraulic servo valves 70 and 71 whereby the valve member 140 of the tripodal alignment valve can shift to the left under the urging of pressure in line 136 as well as a spring 146. As a result, the line 132 is blocked from supply pressure in line 135 and is connected to line 137 extending to the return line 52 to bleed pressure at the port 133 of the main control valve.

A shutoff valve interlock rod 150 is associated with a piston 151 and is normally held inactive by pressure extended to the underside of the piston 151 from the line 77 and with the upper side thereof being supplied with pressure from line 127 through the shutoff valve and a passage 152. When the shutoff valve 78 shifts to lock position, the underside of the piston 151 is connected to return by bleeding through the electro - hydraulic servo valves with pressure remaining on the upper side of the piston whereby the interlock rod 150 can move into a groove on the stem of the valve member and lock the shutoff valve in lock position. This movement of the valve member 141 of the shutoff valve activates a failure monitor switch 155.

The foregoing operation has disabled the electro-hydraulic servo valves 70 and 71 in the first hydraulic power system, while the main control valves 40 and 54 still remain operable under the control of the spool actuator 67. This must occur with the tripodal summing member 60 held against tilting movement and this is achieved by structure shown in FIG. 4 and, more particularly, in FIG. 5. This mechanism includes an alignment disc 160 urged against the summing plate 60 by Belleville springs 161 acting against a member 164 fixed to the connecting member 58. In normal operation, the alignment disc 160 is held away from the summing plate 60 by fluid pressure acting in an annular chamber 162 and which is delivered thereto from the port 133 of the main control valve 41 by flow into an internal passage of the valve member 54. The annular chamber 162 is defined by a flange 165 formed on a tubular extension 166 of the alignment disc 160 and a ring 167 keyed into an annular groove in the connecting member 58. When the tripodal alignment valve 131 shifts to connect line 132 to the return line 52, pressure is bled from this chamber and the Belleville springs 161 are effective to urge the alignment disc 160 against the summing plate 60 and bring it to the perpendicular position. This action is assisted by spring means 165*a*, shown in FIG. 4.

Referring back to the shutoff valves 78 and 83, the shut off action of the shutoff valve 78 has been described and, when the latter valve is in the lock position, shown in FIG. 4, there is abutment with the valve member of the shutoff valve 83 to assure that it stays in open position.

Assuming the detecting means associated with the spool actuator 67 operates the failure detection piston 106 when both shutoff valves are in open position, there is a connection of the line 108 to the return line 52, with resulting shift of the shutoff valve 83 to lock position with a valve member 170 thereof moving to the left with a snap action, as previously described in connection with the shutoff valve 78. A shutoff valve interlock 171 is operative and also a failure monitor switch 172. When this occurs, there is a bleed-off of line 132 through the electro-hydraulic servo valve 72, whereby pressure is removed from the chamber 162 of the alignment mechanism for the summing plate 60 whereby the summing plate can be brought to the perpendicular position for continued operation under positioning control of the spool actuators 65 and 66 associated with electro-hydraulic servo valves 70 and 71.

The valve members 141 and 170 of the shutoff valves 78 and 83 are related mechanically so that one valve is open when the other is in lock position.

We claim:

1. A fault detector for a triplexed actuation system having three mechanical inputs comprising, a linearly movable summing member having a pivotal connection to said three inputs at spaced-apart locations, a force-transmitting member pivotally connected to said summing member for transmitting a linear output responsive to movement of the summing member, means operable by the summing member for detecting a tipped position of the summing member when the three mechanical inputs are not applied equally to the summing member because of a failure of one of said mechanical inputs, and means responsive to said tipped position to enable continued operation with less than three mechanical inputs.

2. A fault detector for a triplexed actuation system having three separate input movements comprising, a movable summing member, means pivotally acting on said movable summing member at three spaced locations to apply said input movements individually one at each location to the summing member, a force-transmitting member extending from said summing member at a location within a perimeter defined by said locations and having a pivotal engagement with the summing member, means for detecting pivoting of the summing member when moved by less than three of said input movements of when said input movements are not of equal magnitude, and means responsive to the detection of such pivoting of the summing member to preclude further pivoting of the summing member and enable continued operation of the fault detector.

3. A fault detector as defined in claim 2 wherein said detecting means senses pivotal movement of the movable summing member about the pivotal engagement with the force-transmitting member.

4. A fault detector as defined in claim 2 including link means associated one with each of said locations to transmit movement indicative of movement of the movable summing member at said location.

5. A fault detector as defined in claim 2 wherein said means acting on the movable summing member at three spaced locations comprises three independently movable actuators, a plurality of operated devices associated with said force-transmitting member, feedback means interconnecting said operated devices with said actuators, and means operated by said feedback mechanism when an actuator fails to operate properly to disable the faulty actuator.

6. A fault detector for a triplexed actuation system having three separate input movements comprising, a movable summing member, means pivotally acting on said movable summing member at three spaced locations to apply said input movements individually one at each location to the summing member, a force-transmitting member extending from said summing member at a location within a perimeter defined by said locations and having a pivotal engagement with the summing member, and means for detecting pivoting of the summing member when moved by less than three of said input movements or when said input movements are not of equal magnitude, said detecting means comprising means for sensing pivotal movement of the movable summing member about the pivotal engagement with the force-transmitting member, and further including alignment means operative after pivotal movement of the movable summing member to restore the movable summing member to a normal operative position and lock the movable summing member against pivoting.

7. A fault for a triplexed actuation system having three separate input movements comprising, a movable summing member, means pivotally acting on said movable summing member at three spaced locations to apply said input movements individually one at each location to the summing member, a force-transmitting member extending from said summing member at a location within a perimeter defined by said locations and having a pivotal engagement with the summing member, and means for detecting pivoting of the summing member when moved by less than three of said input movements or when said input movements are not of equal magnitude, said means acting on the movable summing member at three spaced locations comprising three independently movable actuators, a plurality of operated devices associated with said force-transmitting member, feedback means interconnecting said operated devices with said actuators, and means operated by said feedback mechanism when an actuator fails to operate properly to disable the faulty actuator, and further including means for signalling the disablement of a faulty actuator.

8. A fault detector for a triplexed actuation system having three separate input movements comprising, a movable summing member, means pivotally acting on said movable summing member at three spaced locations to apply said input movements individually one at each location to the summing member, a force-transmitting member extending from said summing member at a location within a perimeter defined by said locations and having a pivotal engagement with the summing member, and means for detecting pivoting of the summing member when moved by less than three of said input movements or when said input movements are not of equal magnitude, said means acting on the movable summing member at three spaced locations comprising three independently movable actuators, a plurality of operated devices associated with said force-transmitting member, feedback means interconnecting said operated devices with said actuators, and means operated by said feedback mechanism when an actuator fails to operate properly to disable the faulty actuator, said summing member pivoting from a normal position when moved by less than equal movement of the three actuators when one actuator has failed, and further including means for pivoting the summing member back to said normal position and locking the summing member in said normal position for operation by the actuators which have not failed.

9. A fault detector for a triplexed hydromechanical system having three mechanical position signals comprising, a pair of hydraulic valves having their valve members in spaced-apart alignment and connected together by a connecting member, a summing plate positioned between said hydraulic valves and having a swivel connection interiorly thereof to said connecting member, three members pivotally connected to said summing plate at spaced-apart locations defining apices of a triangle, three independent actuators connected one to each of said members to provide said three mechanical position signals to said summing plate, feedback means between said actuators and said hydraulic valves, and means associated with the feedback means for detecting when a hydraulic valve has not operated in accordance with the operation of the associated actuator for disabling the associated actuator.

10. A fault detector as defined in claim 9 wherein said summing plate pivots about said swivel connection from a normal position when said three mechanical position sigals are not equal, and means responsive to said detecting means determining faulty operation for returning said summing plate to said normal position and locking the summing plate in said normal position to enable continued operation by the actuators which are not disabled.

11. A fault detector as defined in claim 9 wherein said feedback means includes three separate sets of links with two sets of links connected between one hydraulic valve and two of said actuators and the other set of links connected between the other hydraulic valve and the third actuator, and said detecting means senses a greater amount of movement of one feedback linkage when the associated actuator has failed.

12. A fault detector for a triplexed actuation system providing three separate mechanical movements comprising, a movable summing member, means pivotally acting on said summing member at three spaced locations which define the apices of a triangle to apply said mechanical movements individually one at each location to the summing member, a force-transmitting member extending from said summing member at a location within the triangle defined by said locations and having a pivotal engagement with the summing member, means for detecting pivoting of the summing member when the summing member is not moved by three equal mechanical movements, and means causing restoration of the summing member to a nonpivoted disposition.

13. A fault detector as defined in claim 12 including a plurality of links associated one with each of said locations to transmit movement indicative of movement of the movable summing member at said location.

14. A fault detector as defined in claim 12 wherein said means acting on the summing member at three spaced locations comprises three independently movable actuators, a plurality of operated devices associated with said force-transmitting member, feedback means interconnecting said operated devices with said actuators, and means operated by said feedback mechanism when an actuator fails to operate properly to disable the faulty actuator.

15. A fault detector for a triplexed actuation system providing three separate mechanical movements comprising, a movable summing member, means pivotally acting on said summing member at three spaced locations which define the apices of a triangle to apply said mechanical movements individually one at each location to the summing member, a force-transmitting member extending from said summing member at a location within the triangle defined by said locations and having a pivotal engagement with the summing member, means for detecting pivoting of the summing member when the summing member is not moved by three equal mechanical movements, said movable summing member having a nonpivoted position normal to the force-transmitting member, and further including alignment means operative after pivotal movement of the movable summing member to restore the movable summing member to the nonpivoted position and lock the movable summing member against pivoting.

16. A fault detector for a triplexed actuation system providing three separate mechanical movements comprising, a movable summing member, means pivotally acting on said summing member at three spaced locations which define the apices of a triangle to apply said mechanical movements individually one at each location to the summing member, a force-transmitting member extending from said summing member at a location within the triangle defined by said locations and having a pivotal engagement with the summing member, means for detecting pivoting of the summing member when the summing member is not moved by three equal mechanical movements, said means acting on the summing member at three spaced locations comprises three independently movable actuators, a plurality of operated devices associated with said force-transmitting member, feedback means interconnecting said operated devices with said actuators, and means operated by said feedback mechanism when an actuator fails to operate properly to disable the faulty actuator, and means for signalling the disablement of a faulty actuator.

17. A fault detector for a triplexed actuation system providing three separate mechanical movements comprising, a movable summing member, means pivotally acting on said summing member at three spaced locations which define the apices of a triangle to apply said mechanical movements individually one at each location to the summing member, a force-transmitting member extending from said summing member at a location within the triangle defined by said locations and having a pivotal engagement with the summing member, means for detecting pivoting of the summing member when the summing member is not moved by three equal mechanical movements, said means acting on the summing member at three spaced locations comprises three independently movable actuators, a plurality of operated devices associated with said force-transmitting member, feedback means interconnecting said operated devices with said actuators, and means operated by said feedback mechanism when an actuator fails to operate properly to disable the faulty actuator, said summing member pivoting from a position normal to said force-transmitting member when moved by less than equal movement of the three actuators, and further including means for pivoting the summing member back to said normal position and locking the summing member in said normal position for operation by the actuators which have not failed.

18. A fault detector for a triplexed hydromechanical system having three mechanical position signals comprising, a plurality of hydraulic valves having their valve members in spaced-apart alignment and connected together by a connecting member, a summing member having a swivel connection interiorly thereof to said connecting member, three members pivotally connected to said summing member at spaced-apart locations, three independent actuators connected one to each of said members to provide said three mechanical position signals to said summing member, and means for detecting when a hydraulic valve has not operated in accordance with the operation of an associated actuator for disabling the associated actuator.

19. A fault detector as defined in claim 18 wherein said summing member pivots about said swivel connection from a normal position when said three mechanical position signals are not equal, and means responsive to said detecting means determining faulty operation for returning said summing member to said normal position and locking the summing plate in said normal position to enable continued operation by the actuators which are not disabled.

20. A fault detector as defined in claim 19 including feedback means having three separate sets of links with two sets of links connected between one hydraulic valve and two of said actuators and the other set of links connected between another hydraulic valve and the third actuator, and said detecting means sensing a greater amount of movement of one feedback linkage when the associated actuator has failed.

* * * * *